United States Patent [19]

Meier

[11] Patent Number: 4,489,930

[45] Date of Patent: Dec. 25, 1984

[54] APPARATUS FOR COLLECTING FOLDED PRINTED SHEETS

[75] Inventor: Jacques Meier, Bäretswil, Switzerland

[73] Assignee: Ferag AG, Hinwil, Switzerland

[21] Appl. No.: 497,140

[22] Filed: May 23, 1983

[30] Foreign Application Priority Data

Jun. 1, 1982 [CH] Switzerland ..... 3350/82

[51] Int. Cl.[3] ..... B65H 5/30

[52] U.S. Cl. ..... 270/55; 271/204; 198/644

[58] Field of Search ..... 270/54–55, 270/57–58; 271/204; 198/644

[56] References Cited

U.S. PATENT DOCUMENTS 1,043,401 11/1912 Cox ..... 270/55
3,122,362 2/1964 Vollrath et al. ..... 270/57
3,955,667 5/1976 Muller et al. ..... 271/204 X

FOREIGN PATENT DOCUMENTS 2077235 12/1981 United Kingdom ..... 270/55

*Primary Examiner*—E. H. Eickholt
*Attorney, Agent, or Firm*—Werner W. Kleeman

[57] ABSTRACT

Along a collecting conveyor serving to take-up the folded printed sheets in a straddling fashion there is arranged a number of infeed members serving to feed the printed sheets. The infeed members have a delivery region which merges with the collecting conveyor. To increase the efficiency or output of the apparatus without increasing the conveying velocity of the collecting conveyor and to additionally spare the printed sheets from undergoing a sudden change in their direction of movement during the transition from the infeed members to the collecting conveyor, each of the infeed members contain controlled gripper units attached to an endless revolving traction element and serve to grip the fold of the printed sheets. At least the delivery region of the infeed members extends in the same direction as the conveying direction of the collecting conveyor which, in turn contains a number of receiving saddles for receiving the printed sheets, these saddles being arranged at a distance from each other and extending transversely with respect to the conveying direction.

7 Claims, 2 Drawing Figures

APPARATUS FOR COLLECTING FOLDED PRINTED SHEETS

BACKGROUND OF THE INVENTION

The present invention broadly relates to an apparatus for collecting folded printed sheets or the like.

In its more specific aspects the present invention relates to a new and improved construction of apparatus for collecting folded printed sheets and which apparatus is of the type comprising an endless revolving collecting conveyor adapted to take-up each printed sheet in a straddling fashion or configuration, there also being provided a number of infeed means or infeeders arranged along the collecting conveyor, each such infeed means containing a delivery region opening towards or merging with the collecting conveyor.

Generally, such apparatus forms a component of a collective stitching means or of an automatic three-knife trimmer and is arranged forwardly of the actual stitching or trimming apparatus, as the case may be.

In a known apparatus of such type the folded printed sheets to be collected or collated are each individually removed from a related stack, so that the fold forms the trailing edge of the removed printed sheet. The printed sheet is then fed to the collective conveyor in such a way that the fold of the printed sheet is positioned in the conveying direction of the collecting conveyor either upon a conjointly running chain or upon a stationary rail. In the latter case driven entrainment members advance the printed sheet along the rail. The collecting conveyor of the known apparatus thus is comparable to a running "washing line" containing printed sheets which are advanced in spaced relationship from each other.

Due to the subsequent processing or working operation (stitching or trimming) the sets of collected printed sheets thus obtained may not overlap like, for example, in the stream of an imbricated product formation leaving a rotary printing printing press. The rate of advancement or feed velocity of the collecting conveyor in the known apparatus must be comparatively high even if the output of the rotary printing press is intended to be only approximately handled. Such a high feed velocity or rate of advancement of the collecting conveyor is opposed by the circumstance that the infeed means, i.e., the so-called "feeders" in the known apparatus, have an infeed direction which extends more or less at right angles to the advancement direction of the collecting conveyor. The printed sheets thus experience a sudden change in their direction of movement during transfer from the infeed means to the collecting conveyor which will be that much more disastrous for the printed sheets the higher the conveying velocity of the infeed means and the feed velocity of the collecting conveyor. In the prior art apparatus of this type there are thus set relatively modest upper limits for the velocity of the infeed means and that of the collecting conveyor which hardly suffice to handle the output of a rotary printing press.

This may also be the reason why in the known apparatus the printed sheets are removed individually from a stack. The printed sheets, therefore, have to be initially stacked after leaving the rotary printing press in order that afterwards they can again be individually removed from such stacks.

SUMMARY OF THE INVENTION

Therefore, with the foregoing in mind it is a primary object of the present invention to provide a new and improved construction of apparatus for collecting folded printed sheets which is not afflicted when the aforementioned drawbacks and limitations heretofore discussed.

Another and more specific object of the present invention is directed to the provision of a new and improved apparatus for collecting folded printed sheets which, if desired, can, at least with a part of its infeed means, be directly connected to a printing press outfeeding an imbricated formation of printed products.

Now in order to implement these and still further objects of the invention, which will become more readily apparent as the description proceeds, the apparatus of the present development is manifested by the features that, the infeed means comprise endless revolving traction means and controlled gripper units or grippers mounted thereat in spaced relationship from each other. These gripper units serve to grip the printed sheets at the respective fold thereof. At least the transfer or delivery regions of the infeed means extend substantially in the same direction as the conveying direction of the collecting conveyor which, in turn, is equipped with a number of receiving saddles arranged in spaced relationship from each other and extending transversely with respect to the conveying direction of the collecting conveyor. These receiving saddles or saddle members serve to receive the printed sheets.

Since the transfer or delivery regions of the infeed means extend substantially in the same direction as the conveying directing of the collecting conveyor the transfer of the printed sheets to the latter is not associated with a sudden change in the direction of movement. Furthermore, since the receiving saddles of the collecting conveyor are arranged transversely with respect to its conveying direction, and thus, are arranged and oriented in the manner of ladder rungs, considerably more sets of printed sheets can be collected within a defined conveying path. In other words, this means that the collecting conveyor may possess a smaller conveying velocity with constant efficiency or output or, conversely, may collect a considerably larger number of sets of printed sheets at the same conveying velocity.

BRIEF DESCRIPTION OF THE DRAWINGS

The invention will be better understood and objects other than those set forth above, will become apparent when consideration is given to the following detailed description thereof. Such description makes reference to the annexed drawings.

DETAILED DESCRIPTION OF THE PREFERRED EMBODIMENTS

Figure 1:
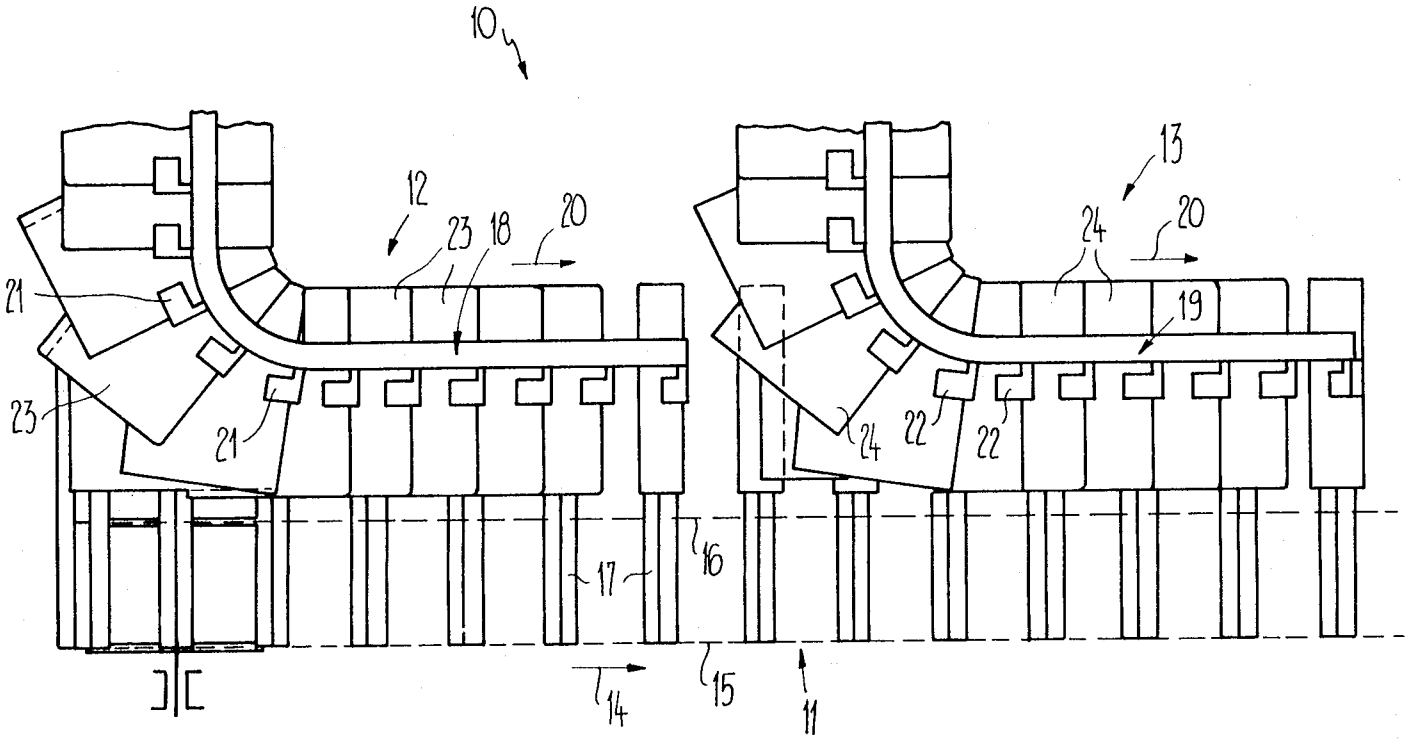
FIG. 1 is a schematic top plan view of a part of a collecting apparatus constructed according to the present invention.

Describing now the drawings, it is to be understood that only enough of the construction of the collecting apparatus has been shown as needed for those skilled in the art to readily understand the underlying principles and concepts of the present development, while simplifying the showing of the drawings.

Turning attention now specifically to the drawings, there has been schematically illustrated therein an apparatus 10 for collecting folded printed sheets which comprises a collecting conveyor 11 and two infeed means or infeed devices 12, 13. The collecting conveyor 11 has a conveying direction which is generally indicated by the arrow 14. As many infeed means 12, 13 and so forth can be operatively associated with the collecting conveyor 11 as would correspond to the number of printed sheets to be collected by the apparatus 10. The collecting conveyor 11 essentially comprises two parallel and endless revolving chains 15, 16. At the chains 15, 16 there are appropriately secured receiving saddles 17 mounted at regular distances or essentially uniform spacing from one another. The receiving saddles 17 extend at right angles relative to the chains 15, 16 and laterally protrude past the chain 16. It will be evident from FIG. 2 that each of the receiving saddles 17 has a substantially prismatic shape possessing a triangular cross-section with one tip or apex of the triangular cross-section pointing away from the chains 15, 16.

The infeed means 12, 13 may be designed as described in U.S. Pat. No. 3,955,667 or in the essentially cognate Swiss Pat. No. 592,562, so that the infeed means 12, 13 have here only been very schematically represented in the drawings and a detailed description thereof can be dispensed with since reference may be readily made to such patents. It should be noted, however, that the transfer or delivery regions 18 and 19 of the infeed means 12 and 13, respectively, extend in the same direction as the conveying direction of the collecting conveyor 11 as indicated by the arrows 20 in FIG. 1.

Each of the grippers or gripper units 21 and 22 of the infeed means 12 and 13, respectively, fixedly retains a respective folded printed sheet 23 and 24, respectively, at the fold thereof. It will seen that each of these grippers or gripper units 21 and 22 of the infeed means or devices 12 and 13 has a not particularly referenced gripper mouth or jaw which extends rearwardly with respect to the conveying direction of the endless revolving collecting conveyor 11. In the embodiment shown in the drawings the printed sheets are non-centrally folded, i.e., as seen from the fold the one portion of the printed sheet is longer than the other portion thereof which is overlapped thereby so as to form a so-called lap margin part. In the graphics profession such a printed sheet is usually called a printed sheet with a "prefold". As will be seen from FIGS. 1 and 2, the infeed means 12 and 13 convey the printed sheets 23 and 24, respectively, to be collected in a kind of spread imbricated product formation, i.e., at a substantially closer sequence than if a space were present between the individual printed sheets as seen in the conveying direction.

Figure 2:
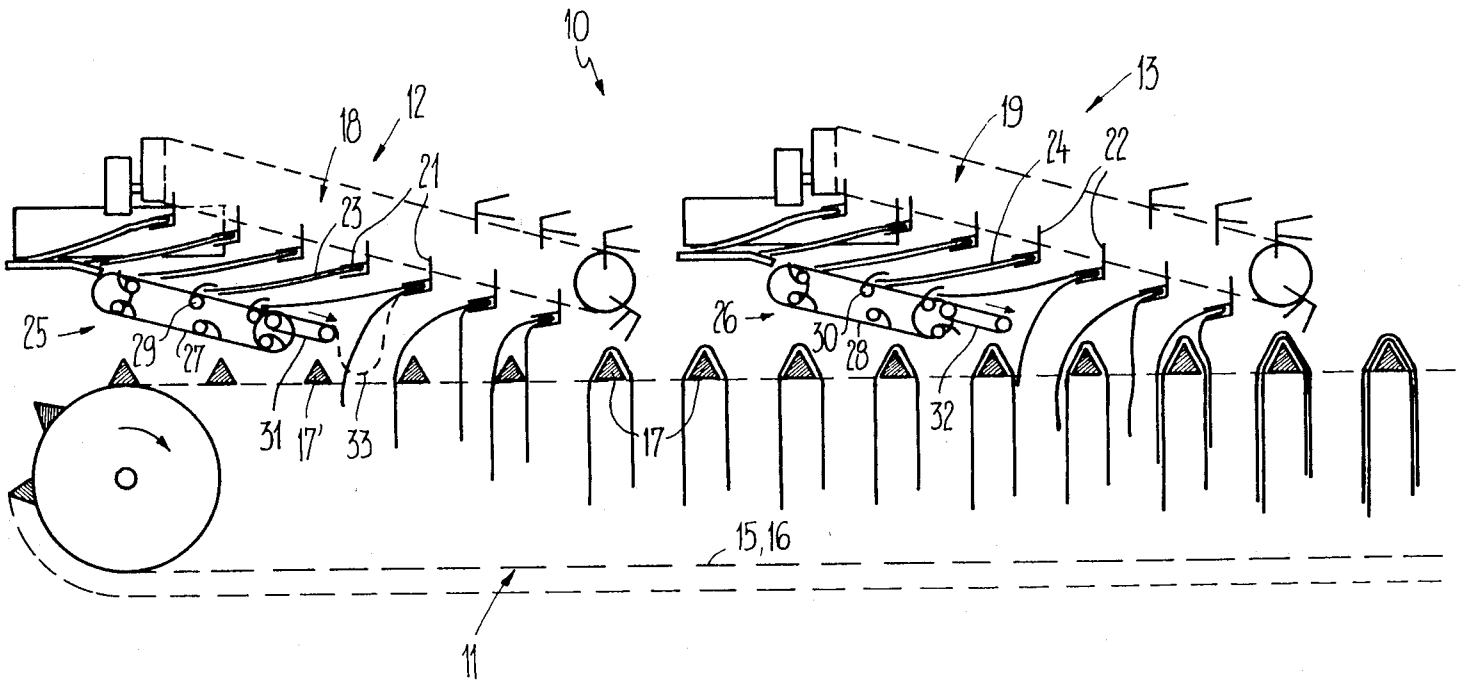
FIG. 2 is a schematic side view of the collecting apparatus shown in FIG. 1.

Each of the transfer or delivery regions 18 and 19 of the infeed means 12 and 13, respectively, is operatively associated with an opening device 25 and 26, respectively, which is illustrated only very schematically in FIG. 2, and by means of which the printed sheets are opened prior to transfer to the collecting conveyor 11.

The opening devices 25 and 26 each comprise a gripper band or belt 27 and 28, respectively, which runs at a circulation or revolving velocity essentially corresponding to the feeding velocity of the infeed means 12 and 13, respectively. Grippers 29 and 30 on the gripper bands 27 and 28, respectively, are spaced at essentially equal distances from one another like the gripper units 21 and 22, respectively of the respective infeed means 12, 13. The grippers 29 and 30 serve to temporarily fixedly retain the trailing edges of the longer portions or lap margin parts of the folded printed sheets while the terminal edge of the shorter portions of the printed sheets positioned therebelow remain free. Small conveyor belts 31 and 32 follow the gripper bands 27 and 28, respectively, and travel at a higher velocity than the conveying or feeding velocity of the infeed means 12 and 13, respectively. When the terminal or trailing edge of the shorter portion of the printed sheets 23 and 24 arrives at the conveyor belts 31 and 32, respectively, this free terminal edge is more rapidly advanced, with the consequence that the shorter portion of the printed sheets 23 and 24, respectively, forms a downwardly directed bulge, whereupon the aforementioned free terminal edge drops to one side of an arriving receiving saddle or saddle member 17. This is illustrated more clearly on the left side of FIG. 2 by the dotted line 33 associated with the receiving saddle 17'. When thereafter the gripper 29 at the end of the gripper band 27 releases the terminal or trailing edge of the longer portion or lap margin part of the printed sheet 23 the related receiving saddle 17' will have been further displaced in the meantime, so that the terminal edge of this longer portion of the printed sheet 23 drops to the other side of such receiving saddle 17'. All of the gripper bands 27 and 28 cooperate in this manner with the respective infeed means 12 and 13 and conveyor belts 31 and 32 and with the collecting conveyor 11. After this step of the operation the gripper units 21 and 22 of the infeed means 12 and 13, respectively, can release the folded printed sheets 23 and 24, respectively, so that the same are positioned in a straddling fashion or configuration upon the corresponding receiving saddle 17 under the action of their own weight.

To reduce the effect of the so-called "travel wind" upon the printed sheets 23 and 24 as much as possible the location at which the gripper units 21 and 22, respectively, of the infeed means 12 and 13, respectively, are opened is placed as closely as possible to the revolving path of travel of the receiving saddles 17. Alternatively, the receiving saddles 17 also may be attached to the chains 15 and 16 such that the leading and trailing surfaces thereof do not form the same angle with the chains 15 and 16 as illustrated in the drawings, but in such a manner that the leading surfaces of the receiving saddles are more markedly inclined or sloped than the trailing surfaces thereof.

As explained initially a stitching apparatus and/or a trimming apparatus may be provided at the non-illustrated end of the collecting conveyor to produce a multi-paged stitched and trimmed or cut printed paper from the collected printed sheets.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for collecting folded printed sheets, comprising:

an endless revolving collecting conveyor defining a predetermined conveying direction and serving to take-up each printed sheet in a straddling configuration;

a number of infeed means arranged along said collecting conveyor for infeeding the printed sheets thereto;

each said infeed means comprising an endless revolving traction means equipped with controlled gripper units mounted thereat in spaced relationship from each other;

each said gripper unit being structured to grip one of said printed sheets at a fold region thereof;

each said infeed means containing a delivery region cooperating with said collecting conveyor;

at least said delivery region of said infeed means extending substantially in the same direction as said predetermined conveying direction of said collecting conveyor;

said collecting conveyor comprising a number of receiving saddles for receiving said printed sheets;

said receiving saddles being arranged in spaced relationship from one another and extending transversely with respect to said predetermined conveying direction; and an opening device associated with said delivery region of each infeed means and acting upon said folded printed sheets in order to open the same.

2. The apparatus as defined in claim 1, wherein:

each of said infeed means having a lower run defining a conveying run thereof;

each of said gripper units having a mouth portion opening towards the rear thereof with respect to said predetermined conveying direction; and said opening device associated with said delivery region of said infeed means comprising a conveyor belt revolving substantially parallel to said delivery region but at a higher velocity in order to separate a trailing portion of said folded printed sheet from another portion thereof.

3. The apparatus as defined in claim 2, especially for processing non-centrally folded printed sheets forming a longer portion as seen from the fold region and having a trailing edge, which longer portion overlaps another portion of said printed sheet having a trailing edge, wherein:

said opening means further comprise a gripper band arranged forwardly of said conveyor belt, extending substantially parallel to said delivery region and revolving at the same velocity as said infeed means;

grippers arranged on said gripper band essentially at the same direction as said gripper units of said infeed means; and said grippers serving to retain the trailing edge of said longer portion until said higher velocity conveyor belt has received and advanced said trailing edge of said other portion of said printed sheet.

4. The apparatus as defined in claim 1, wherein:

each said receiving saddle possesses a substantially prismatic shape having a triangular cross-section; and a tip of said triangular cross-section is directed towards said delivery region of said infeed means.

5. The apparatus as defined in claim 1, wherein:

said endless revolving collecting conveyor comprises two endless chains revolving essentially in parallelism; and said receiving saddles being attached to said two endless chains.

6. The apparatus as defined in claim 5, wherein:

said receiving saddles laterally protrude past one of said chains.

7. An apparatus for collecting folded printed sheets, comprising:

an endless revolving collecting conveyor defining a predetermined conveying direction and serving to support each printed sheet in a straddling configuration;

at least one infeed means arranged along said collecting conveyor for infeeding the printed sheets thereto;

said infeed means comprising an endless revolving traction means equipped with controlled gripper units mounted thereat in spaced relationship from each other;

each gripper unit serving to grip one of said printed sheets at a fold region thereof;

said infeed means containing a delivery region coacting with said collecting conveyor;

at least said delivery region of said infeed means extending substantially in the same direction as said predetermined conveying direction of said collecting conveyor;

said collecting conveyor comprising a number of receiving saddles for receiving said printed sheets;

said receiving saddles being arranged in spaced relationship from one another and extending transversely with respect to said predetermined conveying direction; and an opening device associated with said delivery region of each infeed means and acting upon said folded printed sheets in order to open the same.

* * * * *

UNITED STATES PATENT AND TRADEMARK OFFICE

CERTIFICATE OF CORRECTION

PATENT NO. : 4,489,930

DATED : December 25, 1984

INVENTOR(S) : JACQUES MEIER

It is certified that error appears in the above-identified patent and that said Letters Patent is hereby corrected as shown below:

Column 3, line 36, after "will" please insert --be--

Column 5, line 49, please delete "direction" and insert --distance--

Signed and Sealed this

*Eleventh* Day of *June 1985*

[SEAL]

*Attest:*

DONALD J. QUIGG

*Attesting Officer* *Acting Commissioner of Patents and Trademarks*